US005351034A

United States Patent [19]

Berger et al.

[11] Patent Number: 5,351,034

[45] Date of Patent: Sep. 27, 1994

[54] FIRE DETECTOR

[75] Inventors: Horst Berger, Kaarst; Tido Krippendorf, Düsseldorf; Heiner Politze, Neuss, all of Fed. Rep. of Germany

[73] Assignee: Esser Sicherheitstechnik GmbH, Neuss, Fed. Rep. of Germany

[21] Appl. No.: 845,916

[22] Filed: Mar. 4, 1992

[51] Int. Cl.[5] ..... G08B 17/12

[52] U.S. Cl. ..... 340/577; 250/389; 250/554; 340/578; 340/579; 340/584; 340/693

[58] Field of Search ..... 340/577–579, 340/584, 587, 628–630, 693, 521–522; 250/554, 389; 431/78–79; 422/54

[56] References Cited

U.S. PATENT DOCUMENTS 4,405,919 9/1983 Scheidweiler ..... 340/522

OTHER PUBLICATIONS

"BRK Double-System Smoke & Fire Detector", BRK Electronics Model 3001, Jun. 1984.

*Primary Examiner*—John K. Peng
*Assistant Examiner*—Thomas J. Mullen, Jr
*Attorney, Agent, or Firm*—Henry M. Feiereisen

[57] ABSTRACT

A fire detector includes a scattered light detector unit and an ionization detector unit which are arranged upon a common base at each side of the center axis of a compartment defined by the base and a peripheral wall extending from the base. The scattered light detector includes a light source and a receiver, with their principal axes intersecting in a point of intersection which is positioned at one side of the center axis of the compartment and thus extends eccentric to the center axis. The ionization detector unit includes a holder for a preparation to be ionized, with the holder being arranged at the other side of the center axis. Suitably, a heat detector is further provided in the center axis.

7 Claims, 2 Drawing Sheets

FIRE DETECTOR

BACKGROUND OF THE INVENTION

The present invention refers to a fire detector, and in particular to a fire detector of the type having a scattered light detector unit and an ionization detector unit which are operatively connected to a common system evaluator.

The brochure C 3001 6/84 of the company BRK Electronics describes a fire detector of this type by which an early detection of fire is made possible without increasing the frequency of faulty alarms. The principle of this fire detector is based on the fact that the ionization detector unit responds to the presence of small aerosol particles while the scattered light detector unit reacts early to the presence of large aerosol particles because of their high scattering capability. This conventional fire detector includes a housing which accommodates the ionization detector unit and the scattered light detector unit in separate compartments, with both detector units communicating with separate air inlet openings. Therefore, this fire detector is of comparably large diameter, with only one of the detector units including circumferentially spaced air inlet openings and thus having a responsiveness which is essentially independent of the direction of flow.

SUMMARY OF THE INVENTION

It is an object of the present invention to provide an improved fire detector obviating the afore-stated drawbacks.

In particular, it is an object of the present invention to provide an improved fire detector which is of compact design and includes detector units with a responsiveness essentially independent of the direction of flow.

These objects and others which will become apparent hereinafter are attained in accordance with the present invention by providing a compartment which has an open top covered by a wire grating and allowing inlet of air and which commonly houses the scattered light detector unit and the ionization detector unit, with the scattered light detector including a light source and a receiver which define principal axes intersecting in a point of intersection which is eccentric to the center axis of the compartment and with the ionization detector unit including a preparation holder which is supported by a plastic body at the side thereof facing away from the point of intersection of said principal axes of the light source and the receiver, with the plastic body being arranged between the light source and the receiver in the center axis of the compartment for providing a light trap.

The present invention is based on the fact that the scattered light detector unit and the ionization detector unit are arranged in a same plane within a common compartment, with the scattered light detector unit and the ionization detector unit being provided with common circumferentially spaced air inlet openings. The compartment is suitably defined by a base plate, upon which the scattered detector unit and the ionization detector are placed, and a wall of hollow truncated cone shaped configuration with open top for inlet of air.

Even though in contrast to conventional fire detectors, neither one of the detector units is arranged in the central axis of the fire detector, practice has shown, that through suitable configuration of the compartment the directional dependence of the responsiveness or sensitivity of the detector units can be kept within acceptable limits for a wide range of applications despite their eccentric location of the space within which the aerosol concentration is determined. In addition, the flow through the measuring space of the scattered light detector unit can be done at superior shielding from extraneous light i.e. at low flow resistance. The adverse effect of extraneous light on the scattered light detector unit can be kept to a minimum by suitable design of the respective tube for the light source and the receiver as well as by the plastic body arranged between the light source and the receiver. In electronic signal processing, further measures for suppressing extraneous light may include, in particular, formation of a differential signal.

None of these measures adversely interferes with the flow through the measuring space of the scattered light detector unit.

Suitably, the ionization detector unit has a measuring chamber and a reference chamber which include a common electrode supported by the preparation holder, with the reference chamber including a reference electrode which is spaced from the common electrode, and with the measuring chamber including a reference electrode which is defined by those parts of the base, wall and wire grating which adjoin the holder. Suitably, these parts are made of conductive material. A direct flow through the reference chamber of the ionization detector unit can be kept low through suitable design of the preparation holder and short paths between the respective electrodes, and possibly through additional flow screens.

Preferably, the compartment is defined by a wall of hollow truncated cone shaped configuration with an angle of taper being adapted as to minimize reflection of light in direction of the receiver of the scattered light detector unit.

According to a further feature of the present invention, a flow guiding ring may be arranged in a space above the wire grating. The flow guiding ring has substantially the configuration of a spherical cap shaped ring and has an inner opening of substantially pulvinated cross section so as to define opposing inwardly bulging sections which are respectively positioned above the light source and the receiver. Through provision of such a flow guiding ring, the directional independence of the responsiveness of both detector units can be even further increased.

The selected design of a fire detector according to the invention allows also the use of a heat detector which can be disposed in the center axis of the compartment above the plastic body. The responsiveness of such a heat detector is completely independent of the direction of flow.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
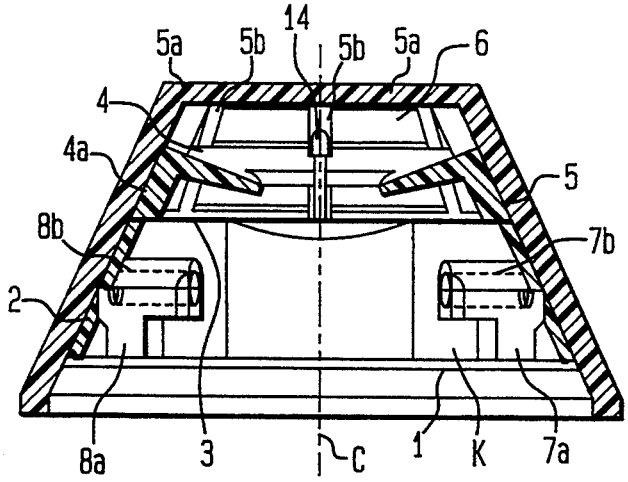
FIG. 1 is a partly sectional side view of one embodiment of a fire detector according to the present invention.

Throughout all the Figures, the same or corresponding elements are always indicated by the same reference numerals.

Figure 2:
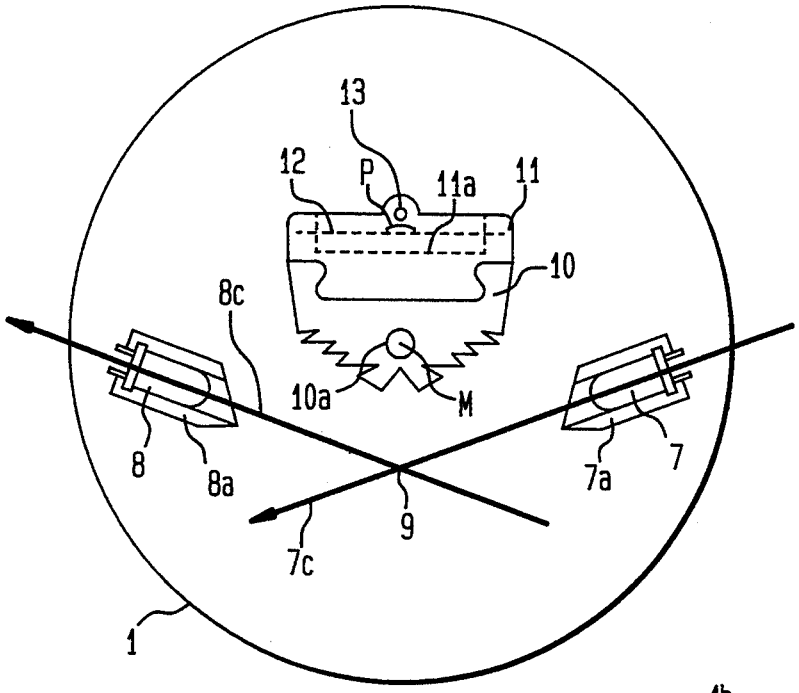
FIG. 2 is a plan view of the circular baseplate of the fire detector of FIG. 1.

Referring now to the drawing and in particular to FIG. 1, there is shown a partly sectional side view of one embodiment of a fire detector according to the present invention. The fire detector includes a plate-shaped base or board 1 which, as shown in FIG. 2, is of circular configuration. Fixedly secured to the perimeter of the baseplate 1 is a housing 5 of hollow truncated cone shaped configuration. Opposite to the baseplate 1, the housing 5 is closed by a lid 5*a* which is secured to the housing 5 via a plurality of narrow webs 5*b*, with the spacing between the webs 5*b* defining circumferentially spaced air inlet openings 6.

Attached upon the perimeter of the baseplate 1 and extending along a portion of the inside wall of the housing 5 is a hollow truncated cone shaped wall 2 which together with the baseplate 1 defines a compartment K. The top of the compartment K is covered by a tightly meshed wire grating 3 which is placed upon the wall 2 and allows air entering through the inlet openings 6 to flow into the compartment K. At its side distant to the compartment, the wire grating 3 carries lateral supports 4*a*, with a flow guiding ring 4 being securely attached thereto.

Turning now to FIG. 2, there is shown a plan view of the baseplate 1, and it can be seen that the fire detector according to the invention includes a scattered light detector unit and an ionization detector unit, which are both contained within the compartment K, as well as a heat detector which is in communication with the interior of the compartment K.

The scattered light detector unit includes a light source 7, e.g. a light emitting semiconductor diode, which emits light in direction of its principal axis 7*c*. The light source 7 is housed in a tube 7*b* which is fixedly secured to the baseplate 1 via a pedestal 7*a*. Disposed essentially in opposition to the light source 7 is a receiver 8, e.g. in form of a photodiode, which defines a principal axis 8*c*. Like the light source 7, the receiver 8 is housed in a tube 8b which is supported by the baseplate 1 via a pedestal 8a. As shown in FIG. 2, the light source 7 and the receiver 8 are arranged within the compartment K in such a manner that their principal axes 7*c*, 8*c* intersect in a point of intersection 9 which extends eccentric to the central axis through center M of the compartment K or baseplate 1.

Arranged between the light source 7 and the receiver 8 is a plastic body 10 which rests upon the baseplate 1. At its side facing the light source 7 and the receiver 8, the plastic body 10 is provided with profiled surfaces so as to act as a conventional light trap. In order to prevent any extraneous light from impacting the receiver 8, the baseplate 1, the compartment wall 2, the tubes 7*b*, 8*b* and the pedestals 7*a*, 8*a* are painted black and kept flat. In addition, the angle of inclination of the compartment wall 2 relative to the baseplate 1 is selected as to minimize light emitted from the light source 7 as well as extraneous light from being reflected by the compartment wall 2 in direction of the axis 8*c* of the receiver 8. Preferably, the angle of inclination ranges between about 50–70°.

The mode of operation of a scattered light detector unit is generally known and is based on the evaluation of scattered light (Tyndall effect) during occurrence of smoke particles.

Figure 6:
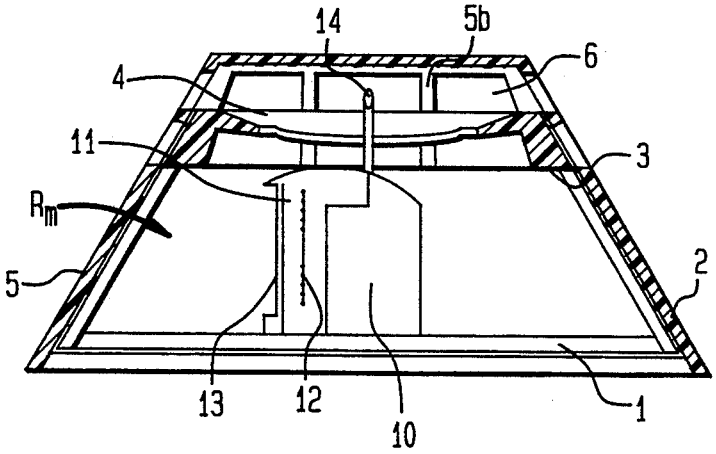
FIG. 6 is a partly sectional side view of the first detector of FIG. 1, with a section of the plastic body being cut away to illustrate the measuring chamber reference electrode.

The ionization detector unit includes a holder 11 which is connected to the plastic body 10 at its side facing away from the point of intersection 9. In the nonlimiting example of FIG. 2, the holder 11 is interlocked with the plastic body 10. The holder 11 is provided with a recess 11*a* which accommodates a plate-shaped electrode 12. Opposing the electrode 12 at a small distance thereto is a wire-shaped electrode 13. The electrode 12, which supports the ionizing preparation P, is the common electrode of the measuring chamber and of the reference chamber of the ionization detector unit. It will be understood by persons skilled in the art that the embodiment of the fire detector as shown in FIG. 2 does not show both chambers to be physically separated spaces; rather they are defined by the (partly common) volume in the area of the respective electrodes, with electrode 13 being the reference electrode in the reference chamber. As shown in FIG. 6, the reference electrode $R_M$ of the measuring chamber is an expanded area defined by those parts of the baseplate 1, compartment wall 2 and wire grating 3 in vicinity of the common electrode and is generally designated by reference character $R_M$ 12. It is thus desired to make the baseplate 1 and the compartment wall 2 of conductive plastic material.

Figure 5:
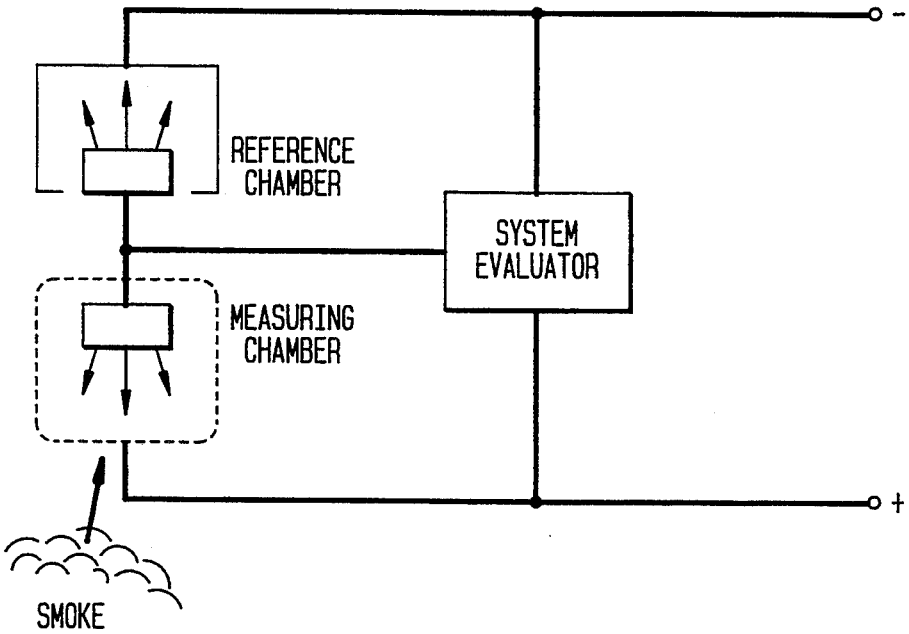
FIG. 5 is a schematic illustration of a principal structure of an ionization detector.

The mode of operation of an ionization detector unit is also generally known and is based on the principle that upon occurrence of smoke in the measuring chamber, the current equilibrium in a bridge circuit is upset to thereby cause triggering of an alarm. A principal structure of an ionization detector is illustrated in FIG. 5.

Persons skilled in the art will understand that the fire detector must contain much additional elements which are not shown in the foregoing Figures. For example, the fire detector must be equipped with a system evaluator which is operatively connected to the scattered light detector unit and the ionization detector unit to process respective signals. Such a system evaluator, which may be suitably arranged below the baseplate 1, and much other elements which are not shown in the foregoing Figures do not form part of the present invention, and thus have been omitted from the Figures for the sake of simplicity.

As is further shown in FIG. 1, the heat detector includes a heat sensor 14 which extends in the center axis C of the housing 5 above the wire grating 3. Suitably, the plastic member 10 is provided with a central bore 10*a* to allow operative connection of the heat sensor 14 with the system evaluator.

Figure 3:
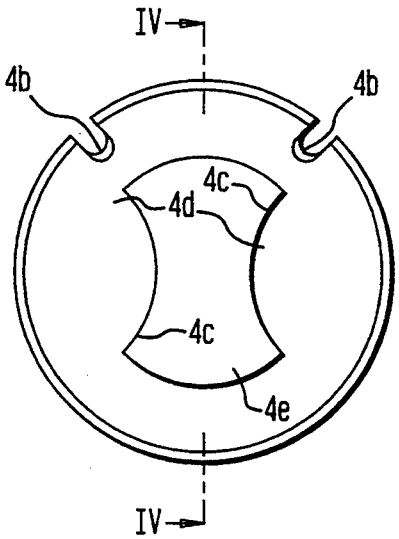
FIG. 3 is a plan view of a flow guiding ring of the fire detector of FIG. 1.

Turning now to FIG. 3, there is shown a plan view of the flow guiding ring 4 which, as shown in FIG. 1, splits the cross sectional area of the air inlet in an upper section and a lower section. The flow guiding ring 4 has essentially the configuration of a spherical cap shaped ring (or the configuration of a cone with a great angle of taper). Spaced about its outer circumference, the flow guiding ring 4 is provided with two recesses 4*b* for supporting profiled light guides (not shown), e.g. plexiglass tubes, by which light signals commensurate with the operational state of the fire detector are transmitted to corresponding apertures (not shown) in the lid 5*a* of the housing 5 to signal to an operator a respective information (e.g. "green"="in operation, no alarm"; "red'-'=alarm). The light guides are operatively connected to respective photodiodes mounted upon the baseplate 1 and run along the wall 2 in compartment K, traverse the wire grating 3 and extend toward the lid 5*a*.

Figure 4:
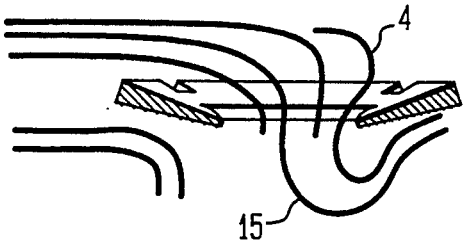
FIG. 4 is a sectional view of the flow guiding ring taken along the line IV—IV in FIG. 3

The flow guiding ring 4 includes an inner opening 4*e* which is defined by two opposing convexly-shaped sides and two opposing concavely-shaped sides of pulvinated configuration, with the concave or inwardly bulging surfaces 4*c* defining small circular segments 4*d*. In the assembled state of the flow guiding ring 4, the circular segments 4*d* are positioned above the light source 7 and receiver 8, respectively. Practice has shown that through this configuration of the flow guiding ring 4, the responsiveness of the scattered light detector unit as well as of the ionization detector unit remains essentially constant regardless of the direction of flow. The reason for that can be explained with reference to FIG. 4, which is a sectional view of the flow guiding ring 4 taken along the line IV—IV in FIG. 3. As can be seen therefrom, the air flow entering through inlet openings 6 is split by the flow guiding ring 4 as indicated by the flow lines 15 so that the respective chambers, despite being spaced from each other and covered by the plastic member 10 and despite the installation of the light source 7 and receiver 8, are evenly filled.

While the invention has been illustrated and described as embodied in a fire detector, it is not intended to be limited to the details shown since various modifications and structural changes may be made without departing in any way from the spirit of the present invention.

What is claimed as new and desired to be protected by Letters Patent is set forth in the appended claims:

1. A fire detector, comprising:

a housing having a base and a lid, said housing being provided with a plurality of circumferentially spaced air inlet openings;

a wall extending along a portion of the inside of said housing about the circumference of said base so as to define a compartment which defines a center axis and has an open top spaced from said lid and allowing inflow of air entering through said air inlet openings;

a wire grating covering said top of said compartment;

a scattered light detector unit and a ionization detector unit arranged together in said compartment, said scattered light detector including a light source defining a principal axis and a receiver defining a principal axis, with said light source and said receiver opposing each other such that their principal axes intersect in a point of intersection which is eccentric to the center axis of said compartment; and a plastic body positioned between said light source and said receiver along the center axis of said compartment for providing a light trap, said ionization detector unit including a holder for a preparation to be ionized, with said holder being attached to a side of said plastic body facing away from said point of intersection of said principal axes of said light source and said receiver.

2. A fire detector as defined in claim 1 wherein said base has a circular configuration.

3. A fire detector as defined in claim 1 wherein said wall is of hollow truncated cone shaped configuration with an angle of taper being adapted to minimize reflection of light in direction of said receiver.

4. A fire detector as defined in claim 1 wherein said ionization detector unit has a measuring chamber and a reference chamber which include a common electrode supported by said holder, said reference chamber including a reference electrode which is spaced from said common electrode, and said measuring chamber including a reference electrode which is defined by those parts of said base, said wall and said wire grating in the vicinity of said common electrode, with said parts being made of conductive material.

5. A fire detector as defined in claim 1, and further comprising a flow guiding ring arranged between said wire grating and said lid and having the configuration of a spherical cap shaped ring, said flow guiding ring having an inner opening defined by opposing inwardly bulging sections which are respectively positioned above said light source and said receiver.

6. A fire detector as defined in claim 1, and further comprising a heat detector arranged in the center axis of said compartment above the plastic body.

7. A fire detector, comprising:

a housing having a housing wall provided with circumferentially spaced air inlet openings, said housing including a compartment defining a center axis and communicating with said air inlet openings;

a scattered light detector unit arranged in said compartment and including a light source and a receiver which are arranged such that their principal axes intersect in a point of intersection which is offset from the center axis of said compartment in a first direction; and an ionization detector unit arranged in said compartment so as to be coplanar with said scattered light detector unit and offset from said center axis of said compartment in a direction opposite that of said first direction.

* * * * *